US006612847B2

(12) United States Patent
Canizales, Jr.

(10) Patent No.: US 6,612,847 B2
(45) Date of Patent: Sep. 2, 2003

(54) SLIP PLATE ASSEMBLY AND METHOD FOR CONDUCTIVELY SUPPLYING ELECTRICAL CURRENT UNDER ROTATIONAL AND TRANSLATIONAL FORCE APPLICATIONS

(75) Inventor: Florencio Canizales, Jr., 1925A Rutland Dr., Austin, TX (US) 78758

(73) Assignee: Florencio Canizales, Jr., Austin, TX (US)

( * ) Notice: Subject to any disclaimer, the term of this patent is extended or adjusted under 35 U.S.C. 154(b) by 104 days.

(21) Appl. No.: 09/975,356

(22) Filed: Oct. 11, 2001

(65) Prior Publication Data

US 2003/0073325 A1 Apr. 17, 2003

(51) Int. Cl.[7] ..... H01R 39/00
(52) U.S. Cl. ..... 439/17; 439/19
(58) Field of Search ..... 439/17, 19, 21, 439/22, 13

(56) References Cited

U.S. PATENT DOCUMENTS

| | | | | | |
|---|---|---|---|---|---|
| 2,583,747 | A | * | 1/1952 | Potter | 343/760 |
| 3,089,113 | A | * | 5/1963 | Mohr | 439/17 |
| 4,904,189 | A | * | 2/1990 | Hallings | 439/13 |
| 5,346,400 | A | * | 9/1994 | Shin | 439/17 |
| 5,470,236 | A | * | 11/1995 | Wissler | 439/12 |
| 5,923,114 | A | * | 7/1999 | Senni | 310/232 |
| 6,265,803 | B1 | * | 7/2001 | Caveney | 310/219 |
| 2002/0034887 | A1 | * | 3/2002 | Dollhofer et al. | 439/17 |

* cited by examiner

*Primary Examiner*—Lynn D. Feild
*Assistant Examiner*—Hae Moon Hyeon
(74) *Attorney, Agent, or Firm*—Wendy Buskop; Bushkop Law Group, P.C.

(57) ABSTRACT

A slip plate assembly (40) for supplying electrical current under rotational and translational force applications, includes a housing (39) and at least one draw unit (70). While subjected to rotational and translational forces, each draw unit (70) disposed within the housing (39) supplies electric current from a power source (not shown) to a receiving system (90). Each draw unit (70) includes a first electroplate (71), a second electroplate (72), and a plurality of rolling members (76) positioned within a gap (85) formed between the first and second electroplates (71, 72). In traversing this gap (85), each rolling member of the plurality of rolling members (76) contacts the first and second electroplates (71, 72) to create an electrical circuit path therebetween. Each draw unit (70) further includes a support spacer (78) and a resilient element (77). In effect, the support spacer (78) is a stationary platform for enabling the resilient element (77) to push the second plate (72) and the plurality of rolling members (76) against the first electroplate (71). Under rotational and translational forces, the resilient element (77) ensures that the plurality of rolling members (76) contact the first and second electroplates (71, 72) and, thus, maintain the electrical circuit path therebetween. Optionally, to protect the slip plate assembly (40) from external environmental factors, the slip plate assembly (40) may be sealed within an attachment manifold arrangement (100).

17 Claims, 5 Drawing Sheets

SLIP PLATE ASSEMBLY AND METHOD FOR CONDUCTIVELY SUPPLYING ELECTRICAL CURRENT UNDER ROTATIONAL AND TRANSLATIONAL FORCE APPLICATIONS

BACKGROUND OF THE INVENTION

1. Field of the Invention

The present invention generally relates to transmitting electrical current between rotating and translating bodies and, more particularly, but not by way of limitation, to a slip plate assembly including at least one draw unit for conductively supplying electrical current under rotational and translational force applications.

2. Description of the Related Art

A receiving system, such as for example electrical Christmas tree lights for use with a tree atop a rotating base, requires electrical current to be delivered from a power source to the receiving system via an electrical circuit path. For purposes of illustration, an electrocable may be provided for establishing an electrical circuit path from the power source to the receiving system. Unfortunately, if rotational forces are exerted on an electrocable, the electrocable often twists on itself or on the receiving system. In short, without integrating rotating electromechanical connectors with the electrocable, rotational forces often damage or destroy the electrical circuit path for transmitting electric current to the receiving system.

One solution typically includes connecting a slip ring and brush apparatus with an electrocable. With a sliding brush, a slip ring and brush apparatus transmits electrical current between relatively rotatable slip rings. Thus, as rotational forces from the electrocable rotate adjacent slip rings, an electrical circuit path is established between these slip rings through the sliding brush. However, because of frequent frictional wear between the slip rings and the brush, slip ring and brush apparatuses commonly provide a short operational life. Maintaining, repairing, and replacing brushes, brush holders, and slip rings associated with the slip ring and brush apparatuses often becomes a costly option.

Currently, slip ring and rolling contact apparatuses provides a cheaper alternative to a slip ring and brush apparatus. In effect, brushes are replaced with cheaper, electrically conductive rolling contacts. The rolling contacts roll within an annular space formed between adjacent and radially spaced rings. As rotational forces from an electrocable rotate the rings about a horizontal axis, the rolling contacts roll against the adjacent rings and conduct electrical current therebetween.

A shortcoming of the slip ring and roller bearing apparatus is that the electrical contact between adjacent slip rings and roller bearing cannot accommodate compressive- and tensile-translational forces exerted from the electrocable. Respectively, the pushing and pulling from the compressive- and tensile-translational forces may potentially damage or destroy an electrical circuit path for transmitting electric current to a receiving system. Inasmuch, translational forces disrupt the structural contact maintained and, thus, electrical contact between the slip rings and roller bearings. Although accounting for rotational forces, today's slip ring and roller bearing apparatuses are not configured to also withstand translational force applications.

Accordingly, as a matter of reducing manufacturing time, labor, and cost, there is a long felt need for a slip plate assembly for supplying electrical current under rotational and translational force applications with built in contact wear compensation to maintain the flow of the electrical current as the contact wear.

SUMMARY OF THE INVENTION

In accordance with the present invention, a slip plate assembly for supplying electrical current under rotational and translational force applications, includes a housing and at least one drw unit, each draw unit disposed within the housing. The housing includes a lead wire and a return wire. The lead wire and return wires are each in electrical contact with the draw unit. In operation, each draw unit draws electric current from a power source, through an in-electrocable, across the lead wire to the draw unit. The draw unit then conducts and supplies electric current across the return wire, through an out-electrocable to a receiving system.

Optionally, in one exemplary embodiment, the housing may include shaft throughbore for receiving the in-electrocable therethrough as well as for facilitating any electrical connection of the in-electrocable with the lead wire. A mounting flange is further provided by the exemplary embodiment. The mounting shaft affixes to the end of a shaft or throughbore to permit the passage of a fiber optic rotary joint, a fluid or pneumatic swivel or any other object or device.

Each draw unit supplies electric current to the receiving system, as the receiving system and/or the in -and out-electrocables subject the draw unit to rotational and translational force applications. Each draw unit also includes a first electroplate and a second electroplate. Each draw unit includes a plurality of rolling members positioned within a gap formed between the first and second electroplates. While traversing this gap, each rolling member of the plurality of rolling members contacts the first and second electroplates. Therefore, in operation, an electrical circuit path is created between the first and second electroplates through each rolling member of the plurality of rolling members.

Each draw unit further includes a support spacer, positioned against the second electroplate, and a resilient element, positioned between the support spacer and the second electroplate. As the receiving system and/or the in-and out-electrocables subject each draw unit to rotational and translational forces, the resilient element resiliently supports the second electroplate. In effect, the support spacer is a stationary platform for enabling the resilient element to push the second plate and each rolling member of the plurality of rolling members against the first electroplate. Under rotational and translational forces, the resilient element ensures that the plurality of rolling members contact the first and second electroplates and, thus maintain the electrical circuit path between the first and second electroplates and through each rolling member.

Preferarbly, the draw unit further includes a guide notch disposed on each of the first and second electroplates. Each guide notch on the first and second electroplates then cooperate to define a track for the plurality of rolling members as the plurality of rolling members traverse the gap. Therefore, to ensure a desired position of a plurality of rolling members between a gap, a guide notch provides each first and second electroplates with increases surface area for physical or "structural" contact as well as electrical contact between that electroplate and each rolling member.

To further increase surface area along each guide notch, the plurality of rolling elements are preferably harder than each of the first and second electroplates. As they traverse the gap, the plurality of rolling elements wear against the first and second electroplates to increase surface area for contact between each rolling member and the first and second electroplates. Optionally, to still further increase electrical contact, a conductive coating is deposited on the first and second electroplates about each guide notch.

To protect the slip plate assembly from external environmental factors, the slip plate assembly may be sealed within a housing.

It is therefore an intent of the present invention to provide a slip plate assembly including at least one draw unit for conductively supplying electrical current under rotational and translational force applications.

Still other intentions, objects, features, and advantages of the present invention will become evident to those skilled in the art in light of the following.

DETAILED DESCRIPTION OF THE PREFERRED EMBODIMENT

As required, detailed embodiments of the present invention are disclosed herein, however, it is to be understood that the disclosed embodiments are merely exemplary of the invention, which may be embodied in various forms, the figures are not necessarily to scale, and some features may be exaggerated to show details of particular components or steps.

Figure 1:
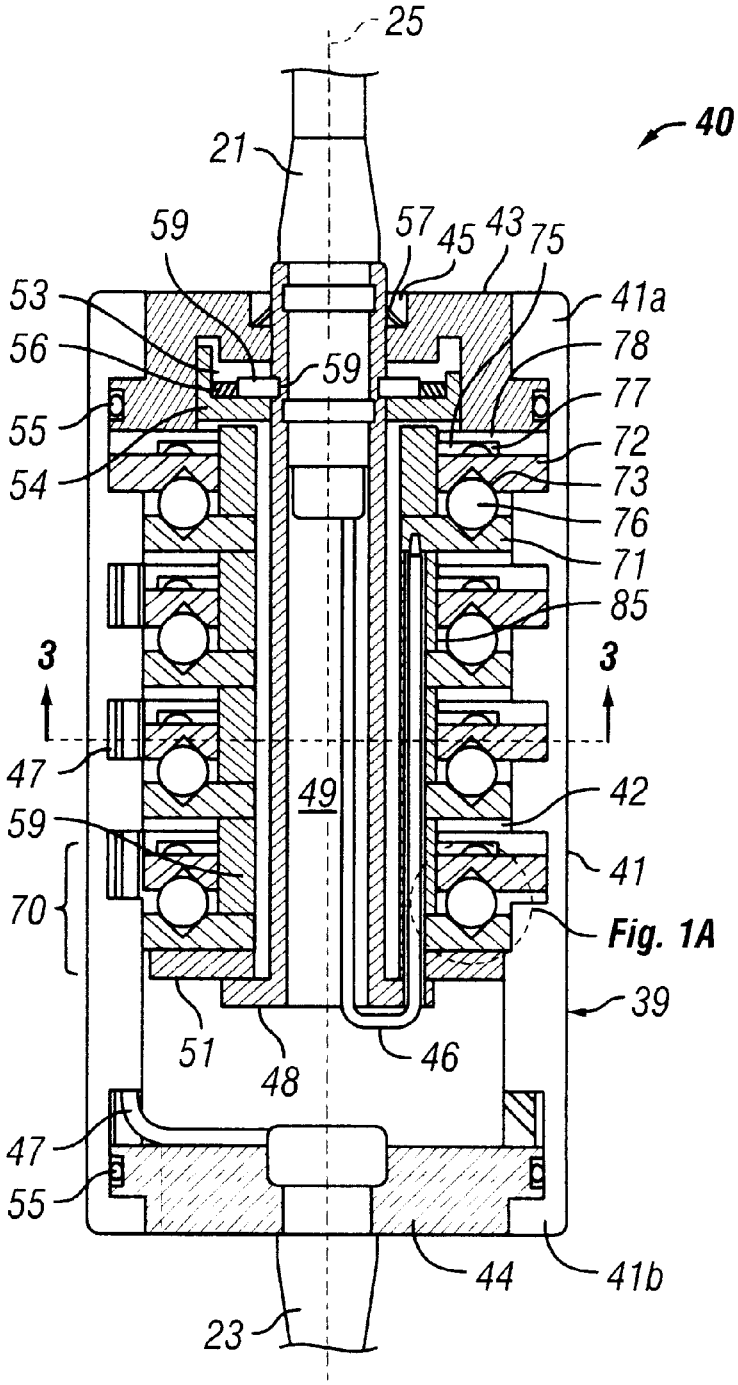
FIG. 1 is a transverse view along an assembly axis illustrating a slip plate assembly (40) according to the preferred embodiment, the slip plate assembly including at least one draw unit (70) for conductively supplying electrical current under rotational and translational force applications.
Figure 1A:
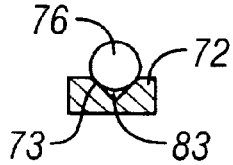
FIG. 1A is a close-up view illustrating the conductive coating deposited about a guide notch and contacting a rolling member.

Generally, FIGS. 1–5 illustrate a slip plate assembly 40. In FIG. 1, the slip plate assembly 40 includes a housing 39 and at least one draw unit 70 disposed within the Housing 39. The housing 39 includes a lead wire 46 and a return wire 47. The lead wire 46 and return wire 47 are each in electrical contact with the draw unit 70. In operation, referring to FIG. 1, each draw unit 70 draws electric current from a power source (not shown), through an in-electrocable 21, across the lead wire 46 to the draw unit 70. The draw unit 70 then conducts and supplies electric current across the return wire 47, through an out-electrocable 23 to a receiving system 90 shown in FIG. 5.

It must be added that each draw unit 70 supplies electrical current under rotational and translational force applications. Particularly, each draw unit 70 supplies electric current to the receiving system 90 as forces applied along the in- and out-electrocables 21, 23 subject the draw unit 70 as well as the slip plate assembly 40 to rotational and translational forces. By definition, a receiving system refers to any system that consumes electric current and/or electrical signals. In general, a receiving system subjects each draw unit to rotational and/or translational forces, whereby these forces are often transmitted along the in electrocable 21 and the out electrocables, 23.

Illustratively, for example, a receiving system may include a large rotating commercial roadway sign positioned atop pylon. Like typical roadway signs in the industry, the sign includes a translucent housing so that electric lights from within the translucent housing illuminate the sign. Thus, to light the sign, the sign draws electric current from the draw unit 70. Moreover, due to the weight of the sign, the rotating sign subjects the draw unit 70 and slip plate assembly 40 to rotational forces and compressive-translational forces. Another example of a receiving system may comprise a tethered underwater electromechanical apparatus for cleaning swimming pools or for gathering underwater visual images. Therefore, while maneuvering through the water, the draw unit 70 and the slip plate assembly 40 are subjected to external rotational as well as tensile- and compressive-translational forces.

In one exemplary embodiment, the total number of draw units included within a slip plate assembly ultimately depends on the total amount of electrical current required by a receiving system. In continuing the illustration, the road sign may require three draw units if the source is 110 VAC, input, output, and one ground. Although determining the number of draw units for a slip plate assembly is out of the scope of this invention, it should be added that the slip plate assembly 40 preferably includes at least one draw unit 70. For purposes of illustration, FIGS. 1–5 show the slip plate assembly 40 including four draw units 70.

Figure 2:
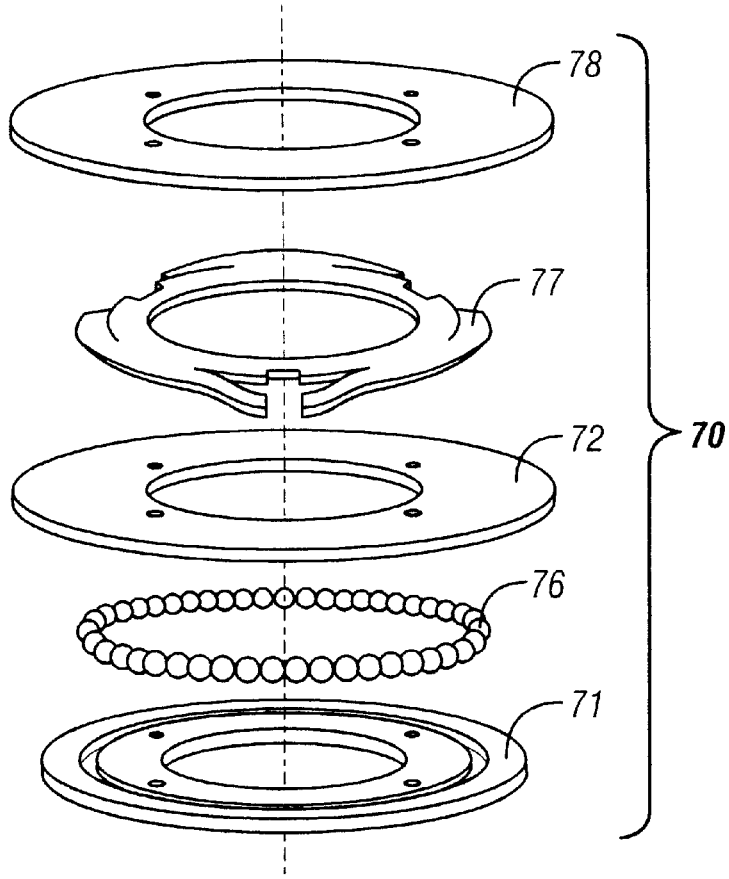
FIG. 2 is an exploded perspective view illustrating the slip plate assembly of FIG. 1.

With specific reference to FIG. 2, each draw unit 70 includes a first electroplate 71 and a second electroplate 72. The first and second electroplates 71, 72 are composed of a material that conducts electrical current, such as for example a copper alloy. Shown in FIG. 1, a gap 85 is formed between the first and second electroplates 71, 72. Accordingly, the draw unit 70 includes a plurality of rolling members 76 positioned within the gap 85 shown to be ball shaped structures in FIG. 2. Each rolling member of the plurality of rolling members 76 contacts the first and second electroplates 71, 72. Additionally, each rolling member of the plurality of rolling members 76 is composed of a material that conducts electrical current, such as an aluminum bronze. Discussed in greater detail below, the plurality of rolling members 76 traverses the gap 85 between the first and second electroplates 71, 72. In operation, an electrical circuit path is created between the first and second electroplates 71, 72 through each rolling element of the plurality of rolling elements 76.

Each draw unit 70 further includes a support spacer 78. The support spacer 78 is positioned against the second electroplate 72. Moreover, referring to FIGS. 1 and 2, the support spacer 78, the first electroplate 71, and the second electroplate 72 are each perpendicularly spaced from assembly axis 25. FIGS. 1 and 2 also show each draw unit 70 including a resilient element 77 positioned between the support spacer 78 and the second electroplate 72.

Preferably, as shown in FIG. 1, the support spacer 78 defines a containment cavity 75. In one exemplary embodiment, the resilient element 77 is disposed within the containment cavity 75 between the support spacer 78 and the second electroplate 72. In another exemplary embodiment, the resilient element 77 comprises a disk spring that is used in conjunction with bearings to absorb vibration, end play and skidding on parts rotating at high speed. In another exemplary embodiment, the resilient element 77 comprises a wave disc spring used for the axial loading of ball bearings to reduce noise and eliminate end play.

As the forces along the in- and out-electrocables 21, 23 and/or the receiving system 90 subject the draw unit 70 to rotational and translational forces, the resilient element 77 resiliently supports the second electroplate 72. For this disclosure and appended claims, the term "resiliently supports" is defined in that the resilient element 77 and the second electroplate 72 are linked to one another such that if the second electroplate 72 is displaced from a normal position to a displaced position, the resilient element 77 acts to return the second electroplate 72 to the normal position.

In effect, the support spacer 78 is a stationary platform for enabling the resilient element 77 to push the second plate 72 and each rolling member of the plurality of rolling members 76 against the first electroplate 71. The resilient element 77 ensures that the plurality of rolling members 76 contact the first and second electroplates 71, 72 and, thus, maintains the electrical circuit path between the first and second electroplates 71, 72 through each rolling member of the plurality of rolling members 76.

Figure 3:
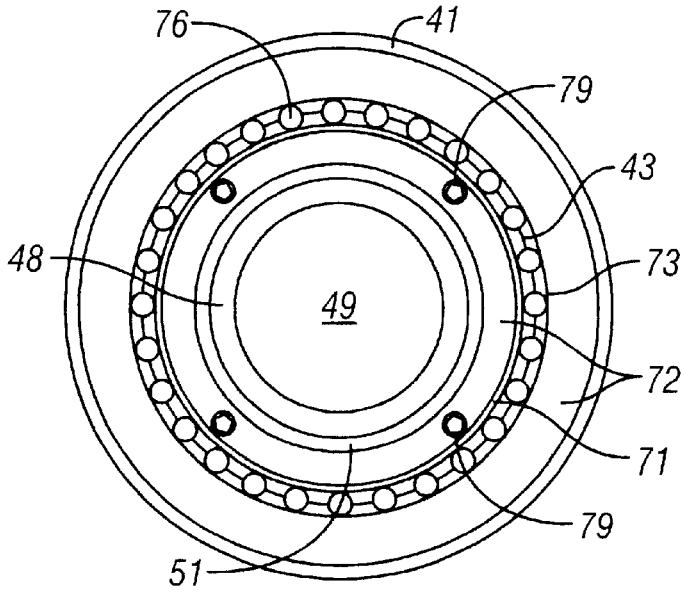
FIG. 3 is a cross sectional view illustrating the slip plate assembly of FIG. 1 along the sectional line 3—3.

Referring to FIGS. 1–3, the draw unit 70 further includes a guide notch 73 disposed on each of the first and second electroplates 71, 72. Each guide notch 73 contacts each rolling member of the plurality of rolling members 76. In operation, the plurality of rolling members 76 preferably traverse the gap 85 between the first and second electroplates 71, 72 by contacting each guide notch 73 on the first and second electroplates 71, 72. Specifically, as shown in FIG. 1, each guide notch 73 on the first and second electroplates 71, 72 cooperate to define a track for the plurality of rolling members 76 as the plurality of rolling members 76 traverse the gap 85.

In general, to ensure desired positioning of the plurality of rolling members 76 between the gap 85, the guide notch 73 provides each of the first and second electroplates 71, 72 with increase surface area for physical or "structural" contact as well as for electrical contact with each of the first and second electroplates 71, 72. To further increase surface area for structural contact as well as for electrical contact, the plurality of rolling members 76 are preferably harder than the each of the first and second electroplates 71, 72. For example, the rolling members 76 may undergo processes for material hardening or may simply be constructed of a harder material than the first and second electroplates 71, 72. As the plurality of rolling members 76 traverse the gap 85, the plurality of rolling members 76 wear against the first and second electroplates 71, 72 to increase surface area for contact between each rolling member 76 and the first and second electroplates 71, 72.

For purposes of illustration, given that the plurality of rolling members 76 are harder than the surface of each guide notch 73 in contact with the plurality of rolling members 76, the initial "V" shape of each guide notch 73 of FIG. 1 becomes worn to substantially resemble a "U" shape. Thus, a substantially U shape provides greater structural contact and electrical contact with the plurality of rolling members 76 and a V shape. Therefore, in terms of ease of manufacturing each draw unit as well as accounting for differences in manufactured sizes available in the industry for the rolling member 76, a V shape is initially preferred in that the process of mechanical wear provides each guide notch 73 with a shape that will optimally contact the plurality of rolling members 76, such as a substantially U shape for example.

Optionally, to still further increase electrical contact, a conductive coating 83 is deposited on the first and second electroplates 71 and 72. Preferably, as shown in FIG. 1, the conductive coating 83 is deposited about each guide notch 73 and contacts each rolling member of the plurality of rolling members 76. The conductive coating 83 is composed of a conductive material for optimally transferring electric current between the first and second electroplates 71, 72 and the plurality of rolling members 76. Ultimately, the conductive coating 83 provides each guide notch 73 with optimal lubricating and electrical conducting properties. In the preferred embodiment, the conductive coating 83 may be composed of a silver powder grease or an electrical connector lubricant, such as for example the MS-381 series of connector cleaner and lubricant manufactured by the Miller-Stephenson Chemical Company, Inc. of Danbury, Conn., commonly used as a lubricant for electrical connectors applied to printed circuit boards, or CONDUCTO-LUBE lubricant manufactured by the Cool-Amp Conducto-Lube Company of Lake Oswego, Oreg.

Referring now to the housing 39 of the slip plate assembly 40 of FIG. 1, the housing 39 includes a housing wall 41 having a first end 41A and a second end 41B. The housing 39 preferably includes a first housing plate 43, disposed at the first end 41A of the housing wall 41, and a second housing plate 44, disposed at the second end 41B. The housing wall 41, the first housing plate 43, and the second housing plate 44 act in combination to protect each draw unit 70 from unfavorable environmental factors surrounding the slip plate assembly 40, such as water, fluids, dirt, extremes in ambient temperature, and damaging electromagnetic radiation, for example. Ultimately, the housing 39 ensures that each draw unit 70 operates under optimal environmental conditions within the slip plate assembly 40.

It should be added that the housing wall 41, the first housing plate 43, and the second housing plate 44 may be formed as one contiguous piece. However, to reduce manufacturing costs and labor, the housing wall 41, the first housing plate 43, and the second housing plate 44 are preferably separate pieces that are secured together to form the housing 39 using suitable securing means known in the industry.

Figure 4:
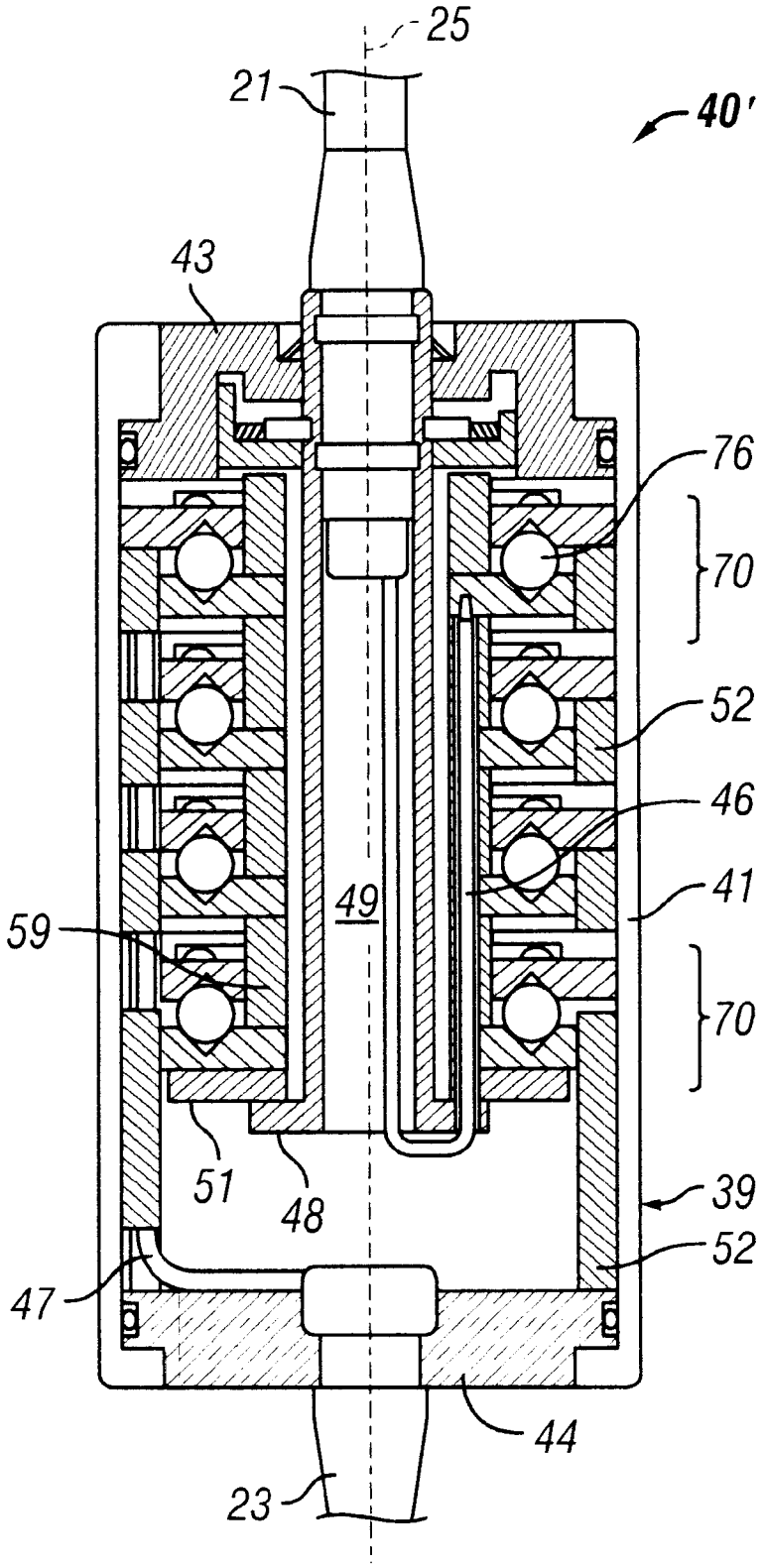
FIG. 4 is a transverse view illustrating an alternative embodiment of a slip plate assembly, specifically a packed slip plate assembly (40').

Furthermore, FIGS. 1–3 show one preferred embodiment of the slip plate assembly 40 whereas FIG. 4 shows another preferred embodiment featuring a packed slip plate assembly 40'. The slip plate assembly 40 and the packed slip plate assembly 40' are structurally identical to one another but for a slight difference in configurations for the housing 39 arising from manufacturing. In particular, the housing 39 of the slip plate assembly 40 of FIGS. 1–3 is molded whereas the packed slip plate assembly 40' of FIG. 4 is constructed of stock components.

The slip plate assembly 40 of FIGS. 1–3 is molded so that the housing wall 41 includes at least one retainer platform 42. Each retainer platform 42 extends from the housing wall 41, along a respective support spacer 78 toward the assembly axis 25. Shown in FIG. 1, the support spacer 78 from each draw unit 70 abuts the retainer platform 42. Thus, the retainer platform 42 keeps the support spacer 78 stationary as the resilient element 77 pushes the second plate 72 and the plurality of rolling members 76 against the first electroplate 71. In addition, the retainer platform 42 divides one draw unit 70 from another such that the first electroplate 71 from one draw unit 70 preferably does not contact the support spacer 78 from another draw unit 70.

The packed slip plate assembly 40' of FIG. 4 is constructed of stock components such that the housing wall 41 preferably comprises tubing of a standard type known in the industry. Whereas each retainer platform 42 of the slip plate assembly 40 supports and divides each draw unit 70 from another, the packed slip plate assembly 40' of FIG. 4 includes a plurality of packing spacers 52. Each packing spacer 52 extends along the housing wall 41, parallel to the assembly axis 25, between the first housing plate 43 and the second housing plate 44. Shown in FIG. 4, each packing spacer 52 contacts a draw unit 70 as well as supports and divides each draw unit 70 from another.

For the packed slip plate assembly 40' of FIG. 4, the packing spacers 52 keep the support spacer 78 stationary as the resilient element 77 pushes the second plate 72 and the plurality of rolling members 76 against the first electroplate 71. In a manner similar to that of the stabilizing manner provided by the retainer platform 42 of FIG. 1, the support spacer 78 from each draw unit 70 abuts the packing spacers 52. Accordingly, to further stabilize the support spacer 78 during operation, the packing spacers 52 are held in position by the first housing plate 43, the second housing plate 44, and the housing wall 41. FIG. 4 also shows the packing spacers 52 dividing one draw unit 70 from another such that the first electroplate 71 from one draw unit 70 preferably does not contact the support spacer 78 from another draw unit 70.

In short, the retainer platform 42 of FIG. 1 and the packing spacers 52 of FIG. 4 are a primary structural difference between the slip plate assembly 40 and the packed slip plate assembly 40'. For illustrative purposes, because the slip plate assembly 40 and the packed slip plate assembly 40' are structurally identical to one another, consider below the housing 39 for the slip plate assembly 40 of FIG. 1.

For the slip plate assembly 40, the housing 39 further includes a plurality of draw spacers 51. As shown in FIG. 1, each draw spacer of the plurality of draw spacers 51 is in contact with at least one draw unit 70. Each draw spacer 51 optimally positions at least one draw unit 70 with respect to the housing 39. In particular, referring to each draw unit 70, each draw spacer of the plurality of draw spacers 51 perpendicularly spaces the support spacer 78, the first electroplate 71, and the second electroplate 72 from the assembly axis 25.

In addition to positioning, each draw spacer 51 electrically insulates the first and second electroplates 71, 72 from one another and with respect to the housing 39 so that the preferred electrical circuit path travels from the first electroplate 71 through each rolling member 76 to the second electroplate 72. Optionally, due to the heat energy generated by the electrical circuit path between the first and second electroplates 71, 72 and each rolling element 76, each draw spacer 51 may thermally insulate the first and second electroplates 71, 71 from one another and with respect to the housing 39.

Shown in FIG. 1, the housing 39 further includes at least one shaft 48. The shaft 48, longitudinally positioned with the assembly axis 25, extends through the housing 39. The shaft 48 facilitates electrical connection of the in-electrocable 21 with the lead wire. Each draw unit 70 is secured to the shaft 48 so that the shaft 48 optimally positions each draw unit 70 within the housing 39 for connection with the lead and return wires 46. It should also be said that the shaft 48 and each draw spacer 51 cooperatively act to optimally position the draw units 70 with respect to the housing 39.

Although each draw unit 70 of FIGS. 1–5 is preferably positioned at an end of the shaft 48, those of ordinary skill in the art will recognize other configurations of each shaft 48 and draw unit 70 within the housing, such as for example a plurality of shafts 48 each with at least one draw unit 70 positioned thereon or the shaft 48 extending entirely through the housing 39 or the draw units 70 intermittently disbursed along the shaft 48. Moreover, those of ordinary skill in the art will recognize that the shaft 48 may be of any diameter so long as the rotation of the shaft 48 does not exceed the operational and/or structural capabilities of each draw unit 70.

With specific reference to FIGS. 1–5, the shaft 48 preferably defines a shaft throughbore 49. In alignment with the assembly axis 25, the shaft throughbore 49 extends entirely through the shaft 48. Operatively, the shaft throughbore 49 receives the in-electrocable 21 therethrough and facilitates electrical connection with the lead wire 46. In addition to the in-electrocable 21, the shaft throughbore 49 may optionally receive other devices, such as for example fiber optic rotary joints, fluid connectors for rational motion, and/or pneumatic connectors for rotational motion. Accordingly, those of ordinary skill in the art will readily recognize a desired diameter of the shaft throughbore 49 for receiving, in addition to the in-electrocable 21, at least one of these other devices, such as fluid connector for rotary motion.

Figure 6:
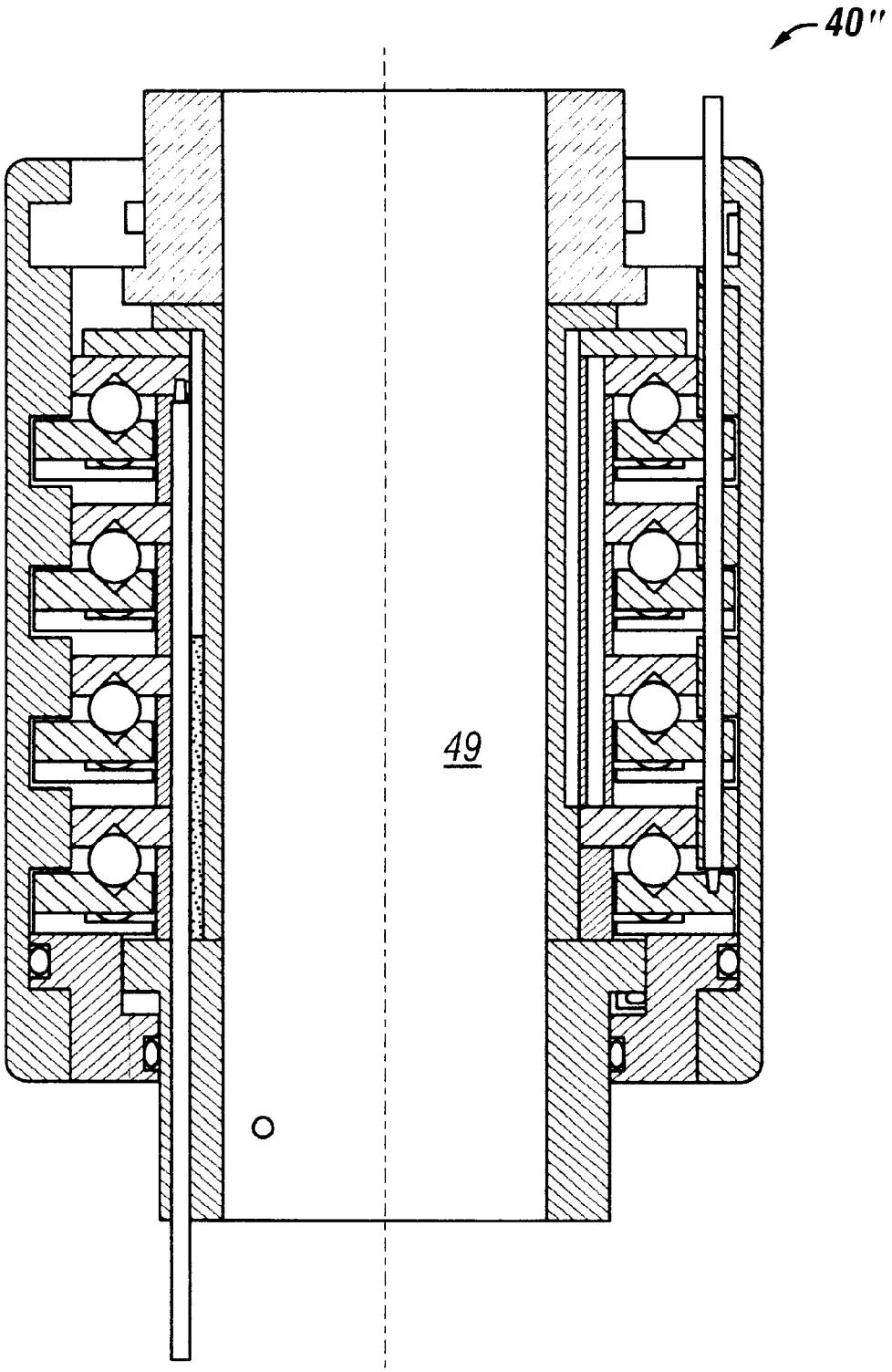
FIG. 6 is transverse view illustrating that a fiber optic rotary joint of an over-the-shaft slip plate assembly may be inserted within the shaft throughbore.

Illustratively, referring to one exemplary embodiment of FIG. 6, a fiber optic rotary joint of an over-the-shaft slip plate assembly 40 may be inserted within the shaft throughbore 49. Thus, positioned within the shaft throughbore 49, optical signals from the fiber optic rotary joint and electrical signals from the in-electrocable 21 may respectively control a receiving system, such as for example a tethered remote operated vehicle.

Shown in FIG. 1, the shaft 48 is secured to the first housing plate 43. Therefore, the shaft throughbore 49 communicates with a plate aperture 45 formed by the first housing plate 43 to facilitate insertion of the in-electrocable 21 within the shaft throughbore 49. Shown in FIG. 1, the shaft 48 is linked with the lead wire 46 so that the lead wire 46 electrically connects with the in-electrocable 21 as the in-electrocable 21 is inserted within the shaft throughbore 49.

In turn, for each draw unit 70, the lead wire 46 is preferably connected to the first electroplate 71 via lead terminals 79 shown in FIG. 3. A resulting electrical circuit path is created from the in-electrocable 21 that is connected to the terminal 79, across the lead wire 46, through the first electroplate 71 and plurality of rolling elements 76 to the second electroplate 72. The second electroplate 72 includes return terminals (not shown) for connection to the return wire 47. Thus, the electrical circuit path continues from the second electroplate 72, through the return wire 47, across the out-electrocable 23 connected to the return wire 47 to the receiving system 90.

Figure 5:
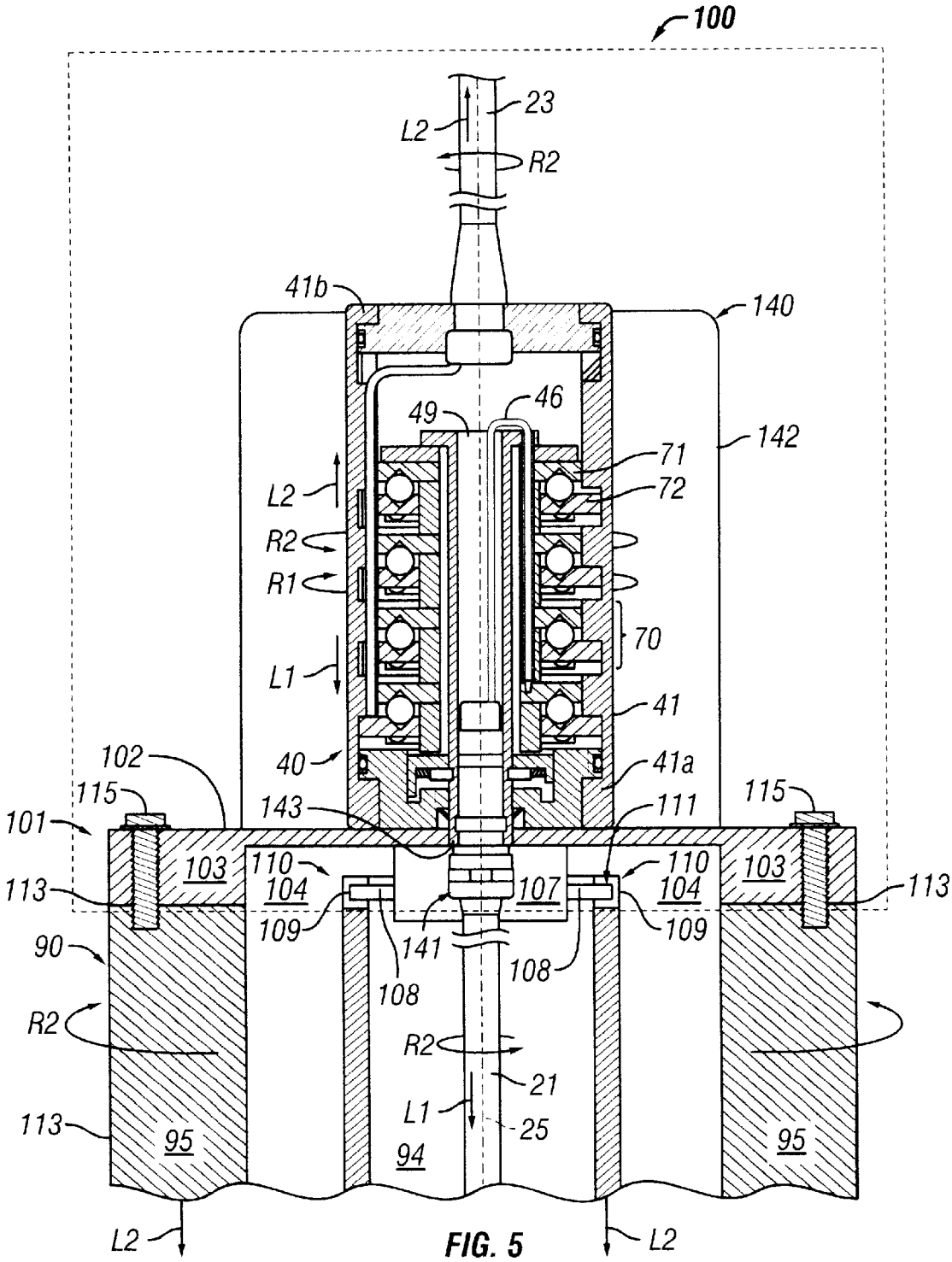
FIG. 5 is a transverse view along an assembly axis illustrating an attachment housing arrangement (100) connected to a receiving system (90), the attachment housing arrangement seals the slip plate assembly of FIG. 1 therein as each draw unit from the slip plate assembly is subjected to rotational and translational forces while supplying electrical current to the receiving system.

Accordingly, electrical operation of each draw unit 70 within the slip plate assembly 40 is as follows. The first electroplate 71 of each draw unit 70 moves feely or, commonly, "slips" within the slip plate assembly 40 in cooperative movement with the in-electrocable 21. In particular, as shown in FIGS. 1 and 5, the shaft 48 is preferably free moving within the slip plate assembly 40 so that, ultimately, the motion of the in-electrocable 21 is correspondingly transferred to the first electroplate 71. Moreover, besides supporting and positioning each draw unit 70 within the slip plate assembly 40, the plurality of draw spacers 51, positioned along the shaft 48, contact the first electroplate 71 such that the motion of the in-electrocable 21 is transferred by the shaft 48 to the first electroplate 71.

Ultimately, each rolling member of the plurality of rolling members 76 mechanically provides for independent movement of the first electroplate 71 with respect to the second electroplate 72 while transferring electrical current therebetween. In particular, so as to provide independent movement of the first and second electroplates 71, 72 the first and second electroplates 71, 72 each slip against each rolling member 76. Through each rolling member 76, an electrical circuit path is established from the first electroplate 71 to the second electroplate 72. Accordingly, as shown in FIGS. 1–4, each rolling member 76 traverses the gap 85 to provide a rolling electrical contact between the first and second electroplates 71, 72. It must be added that each rolling member of the plurality of rolling members 76 is preferably composed of a material having a high compressive strength that will absorb forces exerted from the first and second electroplates 71, 72. In operation, for each draw unit 70, the plurality of rolling members 76 with the gap 85 as well as the resilient element 77 absorb rotational and translational forces exerted from the first and second electroplates 71, 72.

For example, as the in-electrocable 21 rotates counterclockwise, the first electroplate 71, via the plurality of draw spacers 51, cooperatively rotates in the same direction as the in-electrocable 21 while receiving electrical current therefrom. If, for example, the in-electrocable 21 subjects the slip plate assembly 40 to compressive-translational forces, the first electroplate 71 will correspondingly move away from the second electroplate 72. Thus, the resilient element 77 pushes the second electroplate 72 and the plurality of rolling members toward the first electroplate 71 to ensure structural and electrical contact between the first and second electroplates 71, 72 with each rolling member 76. In addition, if the in-electrocable 21 subjects the slip-plate assembly 40 to tensile-translational forces, the first electroplate 71 will correspondingly move toward the second electroplate 72. As such, the resilient element 77 absorbs the displacement resulting from the first electroplate 71 pushing against the second electroplate 72.

Similarly, in the preferred embodiment, the second electroplate 72 of each draw unit 70 moves freely within the slip plate assembly 40 in cooperative movement with the out-electrocable 23. In particular, as shown in FIGS. 1, 4, and 5, the housing 39 moves independently from the movement of the in-electrocable 21, the shaft 48, and first electroplate 71. Besides supporting and positioning each draw unit 70 within the housing 39, each retainer platform 42 of FIG. 1 and, alternatively, each packing spacer 51 of FIG. 4, contacts the second electroplate 72 such that the motion of the out-electrocable 23 is thus transferred from the housing wall 41 to the second electroplate 72. I short, the motion of the out-electrocable 23 is ultimately transferred to the second electroplate 72.

As the out-electrocable 23 rotates clockwise, the second electroplate 72 cooperatively rotates in the same direction as the out-electrocable 21 while receiving electrical current therefrom. If the out-electrocable 23 subjects each draw unit 70 to compressive-translational forces, the second electroplate 72 will correspondingly move away from the first electroplate 71. Thus, the resilient element 77 pushes the second electroplate 72 and the plurality of rolling members toward the first electroplate 71 to ensure structural and electrical contact between the first and second electroplates 71, 72 with each rolling member 76.

In addition, if the out-electrocable 23 subjects the slip plate assembly 40 to tensile-translational forces, the second electroplate 72 will correspondingly move toward the first electroplate 71. As such, each retainer platform 42 of FIG. 1 and, alternatively, each packing spacer 51 of FIG. 4, absorbs the displacement resulting from the second electroplate 72 pushing against the first electroplate 71. Alternatively, to absorb translational forces associated wit this displacement, those of ordinary skill in the art will recognize that a resilient element may be positioned between the second electroplate 72 and each retainer platform 42 of FIG. 1 or, alternatively, each packing spacer 51 of FIG. 4.

Those of ordinary skill in the art will recognize that the first and second electroplates 71, 72 may each rotate in the same direction of rotation or opposite directions of rotation with respect to one another. In other embodiments of the present invention, either the first or second electroplate 71, 72 may operate in a stationary position while the other one of the first or second electroplates 71, 72 moves freely.

Shown in FIG. 1, the housing 39 further includes seals, particularly an O-ring seal 55, a labyrinth seal 54, and a viscous sealant 56. The slip plate assembly 40 includes at least one O-ring seal 55. In FIG. 1, O-ring seals 55 are positioned between the housing wall 41 and the first and second housing plates 43, 44. The O-ring seals 55 protect each draw unit 70 within the housing 39 from unfavorable environmental factors surrounding the slip plate assembly 40, such as water, fluids, dirt, extremes in ambient temperature, and damaging electromagnetic radiation, for example. The labyrinth seal 54 is placed between the first housing plate 43 and the draw unit 70, adjacent to the first housing plate 43. The labyrinth seal 54 protects each draw unit from unwanted fluids and dirt from passing through the housing 39 and damaging each draw unit 70. Moreover, the slip plate assembly 40 includes the viscous sealant 56. Shown in FIG. 1, the viscous sealant 56 is deposited within a sealant chamber 53. The sealant chamber 53 is defined by the first housing plate 43 and the labyrinth seal 54. The viscous sealant 56 keeps dirt and moisture away from each draw unit 70. In the preferred embodiment, the viscous sealant 56 comprises bearing grease, such as one used in boat trailer axles to keep water away from the bearing.

Optionally, with reference to FIG. 1, the housing 39 may include locking devices, specifically a locking member 57 and a snap ring 59. The locking member 57 is positioned at the plate aperture 45 defined by the first housing plate 43. The locking member 57 secures the shaft 48 to the housing 39. Furthermore, the snap ring 59 is positioned within the sealant chamber 53. The snap ring 59 locks each draw unit 70 and the plurality of draw spacers 51 in a desired position within the housing 39. Shown in FIG. 1, the snap ring 59 locks against a snap ring groove 58 defined by the shaft 48. During maintenance and repair, the draw units 70 are thus removed from the housing 39 by releasing the snap ring 59 from the snap ring groove 58.

With reference to FIG. 5, the slip plate assembly 40 is sealed within an attachment manifold arrangement 100. Ultimately, the attachment manifold arrangement 100 seals the slip plate assembly 40 from unfavorable environmental factors surrounding the slip plate assembly 40 and external to the attachment manifold arrangement 100, such as water, fluids, dirt, extremes in ambient temperature, and damaging electromagnetic radiation. Illustratively, for example, the attachment manifold arrangement 100 may be submerged in a swimming pool so that the slip plate assembly 40, sealed within the attachment manifold arrangement 100, supplies electrical current to an underwater electromechanical apparatus that cleans swimming pools. In operation, the receiving system 90 and/or the in- and out-electrocables 21, 23 subject the attachment manifold arrangement 100 and slip plate assembly 40 to rotational and translational forces as the slip plate assembly 40 is sealed within the attachment manifold arrangement 100.

The attachment manifold arrangement 100 includes an attachment interface 101 and an assembly manifold 140 linked with the attachment interface 101. As the attachment interface 101 connects to the receiving system 90, the slip plate assembly 40 operates from within the assembly manifold 140. Therefore, within the assembly manifold 140, the slip plate assembly 40 supplies electric current to the receiving system 90 through the attachment interface 101.

Shown in FIG. 5, the assembly manifold 140 includes a manifold housing 142. The manifold housing 142 contacts the slip plate assembly 40 at the first and second ends 41A, 41B of the housing wall 41. Accordingly, in alignment with the assembly axis 25, the slip plate assembly 40 is secured to the manifold housing 142. The assembly manifold 140 defines a manifold aperture 143. The manifold aperture 143 communicates with the shaft throughbore 49 of the slip plate assembly 40 to receive the in-electrocable 21 therethrough. Optionally, the assembly manifold 140 may include a cable connector 141. In alignment with the assembly axis 25, the cable connector 141 connects the in-electrocable 21 with the manifold housing 142 and, at the manifold aperture 143, seals the slip plate assembly 40 from unfavorable environmental factors.

In FIG. 5, the attachment interface 101 includes a mating surface 102. The mating surface 102 receives the manifold housing 142 of the assembly manifold 140 thereon. Those of ordinary skill in the art will recognize any suitable means for securing the assembly manifold 140 to the mating surface 102, such as welding, fasteners, and/or adhesive means.

The attachment interface 101 includes an interface wall 103. Shown in FIG. 5 the interface wall 103 contacts a receiving system wall 95 included with the receiving system 90. Securing elements 115 are provided by the attachment interface 101 for securing the attachment interface 101 to the receiving system wall 95. In addition, a gasket seal 113 is positioned between the interface wall 103 and the receiving system wall 95. The gasket seal 113 protects the out-electrocable 23 from unfavorable environmental elements at that area of contact between the interface wall 103 and the receiving system wall 95. In short, the attachment interface 101 supplies the in-electrocable 21 to the receiving system 90 while ensuring that the out-electrocable 23 is protected from unfavorable environmental elements. Optionally an O ring seal may be used instead of a gasket.

With reference to FIG. 5, the attachment interface 101 further includes a plurality of directional chambers 104. Preferably, each directional chamber 104 is formed by the interface wall 103. Each directional chamber 104 is configured for receiving the out-electrocable 23 therethrough. With respect to the assembly axis 25, each directional chamber 104 establishes a different spatial position from the other directional chambers 104. By inserting the out-electrocable 23 through a desired directional chamber 104, the attachment interface 101 provides for selective spatial positioning of the out-electrocable 23 for optimal reception by the receiving system 90. Therefore, the attachment manifold arrangement 100 facilitates spatial positioning of the out-electrocable 23 in accordance with the configuration of the respective receiving system 90.

Optionally, the attachment interface 101 may include a cable support member 107 for positioning the out-electrocable 23 within the desired directional chamber 104. At least one cable support lock 110 may also be provided for securing the cable support member 107 to the interface wall 103 that defines the desired directional chamber 104. Accordingly, each cable support lock 110 attaches the out-electrocable 23 to the desired directional chamber 104.

Each cable support lock 110 includes a locking key 108. Shown in FIG. 5, the locking key 108 extends from the cable support member 107 to the interface wall 103 defining the desired directional chamber 104. The cable support lock 110 also includes a key receiver 109 connected with the interface wall 103. In operation, to attach the out-electrocable 23 to the desired directional chamber 104, the key receiver 108 receives the locking key 108 via a receiver notch 111 defined by the key receiver 108.

In operation of the attachment manifold arrangement 100, with specific reference to FIG. 5, electric current flows from the in-electrocable 21 through the assembly manifold 140 to the slip plate assembly 40. From each draw unit 70, current then flows from the slip plate assembly 40, across the out-electrocable 23, through the attachment interface 101 to the receiving system 90.

Shown in FIG. 5, each draw unit 70 supplies electric current and/or electrical signals to the receiving system 90 as the receiving system 90 and/or the in- and out-electrocables 21, 23 subject each draw unit 70 to rotational and translational forces. Illustratively, in FIG. 5, the in-electrocable 21 supplies a counterclockwise rotational force, R1, and a tensile-translational force, L1. Rotationally, for example, the first electroplate 71 of each one of the draw units 70 thus rotate counterclockwise with respect to R1 while maintaining the electrical circuit path from the first electroplate 71 to the second electroplate 72 through each rolling member 76. Independent from these force applications supplied by the in-electrocable 21, the receiving system 90 and out-electrocable 23 in FIG. 5 exert a clockwise rotational force, R2, as well as a tensile-translational force, L2. Thus, rotationally, the second electroplate 72 of each one of the draw units 70 rotates clockwise with respect to R2 while maintaining the electrical circuit path from the first electroplate 71 to the second electroplate 72 through each rolling member 76.

Although the present invention has been described in terms of the foregoing embodiment, such description has been for exemplary purposes only and, as will be apparent to those of ordinary skill in the art, many alternatives, equivalents, and variations of varying degrees will fall within the scope of the present invention. That scope, accordingly, is not to be limited in any respect by the foregoing description, rather, it is defined only by the claims that follow.

I claim:

1. A draw unit comprising:

a. a first electroplate;

b. a second electroplate, the first and second electroplates defining a gap there between;

c. a guide notch disposed on each one of the first and second electroplates, each guide notch contacting each rolling member, and each rolling member traverses the gap between the first and second electroplates contacting the guide notch on the first electroplate and the guide notch on the second electroplate;

d. a support spacer positioned against the second electroplate;

e. a resilient element positioned between the support spacer and the second electroplate, the resilient element resiliently supporting the second electroplate; and f. a plurality of ball shaped rolling member axially positioned within the gap, each ball shaped rolling member contacting the first and second electroplates for transferring electrical current while keeping the plates separated.

2. The draw unit according to claim 1 wherein the support spacer, the first electroplate, and the second electroplate are each perpendicularly spaced from an assembly axis.

3. The draw unit according to claim 1, wherein the resilient element pushes the second plate and each rolling member against the first electroplate.

4. The draw unit according to claim 1, wherein an electrical circuit path is created between the first and second electroplates and through each rolling member.

5. A draw unit comprising:

a. a first electroplate;

b. a second electroplate, the first and second electroplates defining a gap there between;

c. a guide notch disposed on each one of the first and second electroplates, each guide notch contacting each rolling member, and each rolling member traverses the gap between the first and second electroplates contacting the guide notch on the first electroplate and the guide notch on the second electroplate;

d. a support spacer positioned against the second electroplate;

e. a resilient element positioned between the support spacer and the second electroplate, the resilient element resiliently supporting the second electroplate; and f. a plurality of ball shaped rolling member axially positioned within the gap, each ball shaped rolling member contacting the first and second electroplates for transferring electrical current while keeping the plates separated, g. and wherein the plurality of rolling elements are harder than each of the first and second electroplates.

6. The draw unit according to claim 5 wherein the plurality of rolling elements wear against the first and second electroplates to increase contact between each rolling member and the first and second electroplates.

7. A draw unit comprising:

a. a first electroplate;

b. a second electroplate, the first and second electroplates defining a gap therebetween;

c. a guide notch disposed on each one of the first and second electroplates, each guide notch contacting each rolling member, and each rolling member traverses the gap between the first and second electroplates contacting the guide notch on the first electroplate and the guide notch on the second electroplate;

d. a support spacer positioned against the second electroplate;

e. a resilient element positioned between the support spacer and the second electroplate, the resilient element resiliently supporting the second electroplate; and f. a plurality of ball shaped rolling member axially positioned within the gap, each ball shaped rolling member contacting the first and second electroplates for transferring electrical current while keeping the plates separated; wherein a conductive coating is disposed on the first and second electroplates, and the conductive coating is contacting each rolling member.

8. A draw unit comprising:

a. a first electroplate;

b. a second electroplate, the first and second electroplates defining a gap therebetween;

c. a guide notch disposed on each one of the first and second electroplates, each guide notch contacting each rolling member, and each rolling member traversing the gap between the first and second electroplates contacting the guide notch on the first electroplate and the guide notch on the second electroplate;

d. a support spacer positioned against the second electroplate;

e. a resilient element positioned between the support spacer and the second electroplate, the resilient element resiliently supporting the second electroplate; and f. a plurality of ball shaped rolling member axially positioned within the gap, each ball shaped rolling member contacting the first and second electroplates for transferring electrical current while keeping the plates separated, g. a containment cavity defined by the support spacer, wherein the resilient element is disposed within the containment cavity between the support spacer and the second electroplate.

9. A slip plate assembly, comprising:

a. a housing; and b. a draw unit disposed within the housing, the draw unit comprising:

i. a first electroplate;

ii. a second electroplate, the first and second electroplates defining a gap therebetween;

iii. a guide notch disposed on each one of the first and second electroplates, each guide notch contacting each rolling member, and each rolling member traversing the gap between the first and second electroplates contacting the guide notch on the first electroplate and the guide notch on the second electroplate;

iv. a support spacer positioned against the second electroplate;

v. a resilient element positioned between the support spacer and the second electroplate, the resilient element resiliently supporting the second electroplate, and vi. a plurality of ball shaped rolling members axially positioned within the gap, each ball shaped rolling member contacting the first and second electroplates for transferring electrical current while keeping the plates separate.

10. The slip plate assembly according to claim 9, wherein the housing includes:

a lead wire, and a return wire, the lead and the return wires each in electrical contact with the draw unit.

11. The slip plate assembly according to claim 10, wherein the housing further refines a shaft throughbore for containing said wires.

12. The slip plate assembly according to claim 11 wherein the housing further includes:

a housing wall including a first end and a second end, a housing first plate positioned at the first end of the housing wall, and a housing second plate positioned at the second end of the housing wall.

13. The slip plate assembly according to claim 12 further comprising:

(a) a shaft secured to the first housing plate, the shaft including a shaft throughbore, the shaft throughbore receiving an in-electrocable therethrough and facilitating electrical connection of the in-electrocable with the lead wire.

14. The slip plate assembly according to claim 12 wherein an out-electrocable is secured to the second housing plate and is electrically connected to the return wire.

15. The slip plate assembly according to claim 9 wherein the housing further includes a plurality of draw spacers, each draw spacer in contact with the draw unit.

16. The slip plate assembly according to claim 9 wherein the housing further includes plurality of packing spacers, each packing spacer in contact with the draw unit.

17. The slip plate assembly according to claim 9 wherein the housing further includes a plurality of seals.

* * * * *